US009976407B2

(12) United States Patent
Ash et al.

(10) Patent No.: US 9,976,407 B2
(45) Date of Patent: May 22, 2018

(54) LOGGING TOOL AND METHOD OF USE

(71) Applicant: Reeves Wireline Technologies Limited, Leicestershire (GB)

(72) Inventors: Simon Christopher Ash, Nottingham (GB); Michael John Chaplin, Warwickshire (GB)

(73) Assignee: Reeves Wireline Technologies Limited, Leicestershire (GB)

( * ) Notice: Subject to any disclaimer, the term of this patent is extended or adjusted under 35 U.S.C. 154(b) by 91 days.

(21) Appl. No.: 14/483,410

(22) Filed: Sep. 11, 2014

(65) Prior Publication Data

US 2015/0068737 A1 Mar. 12, 2015

(30) Foreign Application Priority Data

Sep. 11, 2013 (GB) ..... 1316194.8

(51) Int. Cl.
*E21B 47/01* (2012.01)
*E21B 23/02* (2006.01)
*E21B 23/14* (2006.01)

(52) U.S. Cl.
CPC ..... *E21B 47/01* (2013.01); *E21B 23/02* (2013.01); *E21B 23/14* (2013.01)

(58) Field of Classification Search
CPC ..... E21B 23/02; E21B 23/14; E21B 47/01
See application file for complete search history.

(56) References Cited

U.S. PATENT DOCUMENTS 3,685,158 A 8/1972 Planche
4,926,937 A 5/1990 Hademenos
5,044,437 A * 9/1991 Wittrisch ..... E21B 17/06 166/113
2005/0263280 A1 12/2005 Sellers et al.
2009/0071659 A1 3/2009 Spencer et al.
2011/0277990 A1 11/2011 Kotsonis et al.
2012/0298378 A1 11/2012 McCauley et al.
(Continued)

FOREIGN PATENT DOCUMENTS

CN 203362080 U 12/2013
CN 103541666 A 1/2014
GB 2300870 A 11/1996
(Continued)

OTHER PUBLICATIONS

Search Report received in corresponding GB application No. GB1316194.8, dated Feb. 14, 2014, 3 pages.
(Continued)

*Primary Examiner* — Caroline N Butcher
(74) *Attorney, Agent, or Firm* — Blank Rome LLP

(57) ABSTRACT

A logging tool or logging tool sub (10) for downhole use comprises an elongate cylindrical body (11) having supported thereby one or more movable landing extensions (12) that are movable between an extended position in which part of each said movable landing extension protrudes beyond the exterior of the cylindrical body (11) so as to define one or more exposed landing surfaces that are engageable with one or more landing surfaces (21) of a further component; and a retracted position in which each said movable landing extension (12) protrudes externally of the cylindrical body no further than the exterior thereof (11).

21 Claims, 3 Drawing Sheets

(56) References Cited

U.S. PATENT DOCUMENTS

| | | | | |
|---|---|---|---|---|
| 2013/0104641 | A1 | 5/2013 | Samworth et al. | |
| 2015/0337643 | A1* | 11/2015 | Leach | E21B 41/0007<br>166/250.01 |

FOREIGN PATENT DOCUMENTS

| | | | |
|---|---|---|---|
| GB | 2334046 | A | 8/1999 |
| WO | 2013133890 | A2 | 9/2013 |

OTHER PUBLICATIONS

Examination Report received in corresponding Great Britain application No. GB1423205.2, dated Mar. 2, 2015, 8 pages.

* cited by examiner

LOGGING TOOL AND METHOD OF USE

CROSS-REFERENCE TO RELATED APPLICATIONS

This application claims the benefit of U.K. Appl. GB 1316194.8, filed 11 Sep. 2013.

FIELD OF THE DISCLOSURE

The present disclosure relates to a downhole logging tool and a method of its use.

BACKGROUND OF THE DISCLOSURE

As is well known, prospecting for minerals, hydrocarbons such as oil and gas, and other natural resources of commercial value is economically an extremely important activity. For various reasons those wishing to extract resources from below the surface of the ground or the floor of an ocean need to acquire as much information as possible about both the potential commercial worth of the natural resources in a geological formation and also any difficulties that may arise in extracting them to surface locations at which they may be used.

Techniques of logging of subterranean formations have developed for the purpose of establishing, with as much accuracy as possible, information as outlined above both before extraction activities commence and also while they are taking place.

During drilling operations, a surface hole is drilled to a location near where the prospective resource is located. The boreholes used for the purpose explained above may extend for several thousands or tens of thousands of meters from a surface location.

A drill pipe is typically a hollow, thick-walled, steel piping used on drilling rigs to facilitate the drilling of a borehole/wellbore. The pipe consists of numerous pieces screwed one to another. Each piece of drill pipe is approximately ten meters long. Usually a piece has external male threads at one end and female threads in the internal diameter of the other end. The male threads of one piece engage with the female threads of another piece, thereby joining the pieces of drill pipe together.

Normally while borehole drilling is carried out, a string of compound pieces of drill pipe is used in order to drive a rotatable drill bit mounted at the end of the pipe in contact with the ground.

As the drill bit works its way down into the ground and the borehole length increases, the drill pipe is sequentially extended by adding a new piece of drill pipe at a time to its upper end. As a result long lengths of drill pipe may be inserted into boreholes as they are formed.

Broadly stated, logging involves inserting a logging tool, also known as a sonde, into a borehole or other feature penetrating a formation under investigation; and using the sonde to energise the material of the rock, etc., surrounding the borehole in some way. Passage of the energy through the rock alters its character. The sonde or another tool associated with it that is capable of detecting energy is intended then to receive emitted energy that has passed through the various components in the rock before being recorded by the logging tool.

Typically the logging tool is formed as an elongated, rigid cylinder that may be e.g. one to five meters long.

A wireline, as is well known in the art, is an armoured cable that may be used for the purposes of lowering a logging tool into the borehole, or supporting the tool while it is being withdrawn upwardly along a borehole or well during logging. The logging tool is located at the end of the wireline. Logging measurements are in one known method taken by lowering the wireline to the prescribed depth and then raising it out of the well while operating the logging tool. Wireline is capable of electronically telemetering data from various types of logging tool from downhole to surface locations; and also of sending electronic commands to connected downhole equipment. In some situations however it is not possible or desirable to maintain the wireline connected to the logging tool following deployment of the latter.

Wireline drop-off is a conveyance system that allows for openhole data acquisition while tripping (i.e. the act of pulling the drill pipe out of the hole or replacing it in the hole). In this conveyance technique shown partially in FIGS. 1-2, a logging tool 10' having a memory function is conveyed down-hole by wireline 30 through drill pipe 40 and hangs into the openhole on a no-go at the bottom of the drill pipe 40.

When drilling has reached total depth (the planned end of the well measured by the length of pipe required to reach the bottom), for example, the wireline 30 is released into the drill pipe 40. Typically there is a landing ring 42 in the internal wall of the drill pipe 40, located near the mouth of the final (i.e. most downhole) piece of drill pipe 40, which receives a landing collar 22 located on and protruding outwardly from the tool 10'. The engagement of the landing ring 42 and collar 22 secures the tool 10' and pipe 40 one to another. When this engagement has occurred, the wireline 30 is removed from the well.

The result of this sequence is that part of the logging tool 10' protrudes beyond the end of the drill pipe 40 and therefore is exposed in a way that permits logging of the formation. A further part of the logging tool 10' remains inside the drill pipe 40 and defines the described landing collar connection to the drill pipe 40.

To withdraw the drill pipe 40, the pieces of drill pipe 40 at the surface are unscrewed one by one from each other to separate them. As a result the drill pipe 40 is gradually withdrawn from the borehole B. A dropped-off logging tool 10', therefore, moves towards the surface with the pipe 40, taking records (well logs) of the formation F along the way.

Each time a piece of drill pipe 40 is to be removed from the upper end, the withdrawal operation is interrupted while unscrewing of the drill pipe 40 takes place.

Because drillers often use high-torque couplings to prevent the pieces of drill pipe 40 from coming unscrewed downhole, the pieces may become stuck to each other making it difficult for them to be separated.

The protruding nature of the landing collar 22 on the tool 10' may prevent it from entering drill pipes 40 having a small internal diameter.

The current wireline drop-off technique only enables the tool 10' to log the openhole beyond the landing collar 22 into which the tool 10' protrudes. This limits the length of the openhole where formation data could be acquired. It would however be desirable to log openhole that is well beyond the end of the drill pipe 40.

Moreover, if it is realised that part-way through the drill pipe 40 withdrawal process some parts of the formation F have not been logged, the tool 10' cannot be disengaged from the drill pipe 40 to be lowered while the pipe 40 is downhole. The drill pipe 40 must be removed and the whole operation needs to be repeated to obtain any desired missing logs. This again adds to operation costs.

Typically during the drop-off deployment using the techniques of FIGS. 1-2, the logging tool 10' is conveyed downhole inside the drill pipe 40 connected at its uphole end to wireline 30, the nature and functioning of which are known in the art. Once the tool 10' in the prior art arrangement reaches the position shown in FIG. 2, the collar 22 lands on the landing ring 42 with part of the tool 10' protruding in a downhole direction beyond the end of the drill pipe 40.

The tool 10' is secured in this position and the wireline (30) disconnected from its uphole end. The wireline 30 is then withdrawn entirely from the drill pipe 40. Step by step withdrawal of the drill pipe 40 as described above then permits logging of the borehole B to take place, using on-board battery and memory M of the tool 10'.

However, on occasions, the tool 10' may fail to log sections of the borehole B. Using the prior art arrangement of FIGS. 1-2, it is possible to log such missed regions only by sending the wireline 30 all the way back to the tool 10', reattaching the wireline 30 to the tool 10' (using known wireline latching parts), withdrawing the tool 10' to a surface location and then adding pieces of drill pipe 40 until the end of the drill pipe 40 coincides with the un-logged part of the borehole B.

Thereafter, it is necessary to repeat the tool drop-off steps in order to deploy the tool 10', whereafter it becomes possible to log the missed portions.

This sequence is so time-consuming as to render it uneconomic in many cases. Moreover, the described technique results in the tool 10' passing some parts of the borehole B twice during repeated runs. This is inefficient.

The subject matter of the present disclosure aims to solves one or more problems that exist in the prior art.

SUMMARY OF THE DISCLOSURE

According to the present disclosure in a first aspect there is provided a logging tool or logging tool sub (e.g., logging apparatus) for downhole use comprising an elongate cylindrical body having supported thereby one or more movable landing extensions that are movable between at least a first extended position in which part of each said movable landing extension protrudes beyond the exterior of the cylindrical body so as to define one or more exposed landing surfaces that are engageable with one or more landing surfaces of a further component; and a retracted position in which each said movable landing extension protrudes externally of the cylindrical body no further than the exterior thereof.

Having movable retractable landing extensions enables the tool to become engaged with a landing surface, if so desired, or allows the tool to go beyond a drill pipe landing ring, into openhole. Moreover since the members do not extend beyond the external cylindrical body in the retracted position, the overall external diameter of the logging tool is smaller than in prior art tools having permanently protruding landing parts. This therefore allows the tool to enter drill pipes that have a small diameter.

Preferably the or each movable landing extension is movable to a further extended position in which part of each said movable landing extension protrudes further beyond the exterior of the cylindrical body.

Further preferably each said movable landing extension includes an elongate arm that extends from the cylindrical body, that is secured at a first location to the cylindrical body and that defines one or more said exposed landing surfaces at a further location that is spaced from the first location, the orientation of the one or more exposed landing surfaces causing the arm to be subject to compression between the first and second locations on engagement of the one or more landing surfaces with one or more landing surfaces of a further component.

Such an arrangement is reliable and robust in use.

Conveniently each respective movable landing extension is pivotally secured to the cylindrical body at the first location. The pivotal attachment may be achieved through use of a pivot pin, which is known to be a strong type of movable fastening.

It is further preferable that the cylindrical body includes a respective recess within which a said movable landing extension is receivable when in its retracted position.

The recess allows placing of the landing extension neatly within the tool body when not deployed.

Preferably the tool includes a pivot pin, to which a said movable landing extension is pivotally secured, extending inside each respective recess.

Locating the pivot pins inside the recesses helps to protect the fastening of the movable landing extensions to the cylindrical body against harsh downhole environments.

In preferred embodiments of the disclosed apparatus, the cylindrical body includes a hollow interior; and at least one said recess includes a perforation permitting communication between the hollow interior and a said movable landing extension.

The hollow interior enables the tool to house an actuator. The advantages of such an actuator are outlined below.

As mentioned, preferably the logging tool or logging tool sub includes a movable actuator member in the hollow interior of the cylindrical member, the movable actuator member being engageable with at least one said movable landing extension via a said perforation, movement of the movable actuator member in a predetermined direction in the hollow interior when engaged with a said movable landing extension causing movement of the movable landing extension from the retracted to at least the first extended position.

Such an arrangement is simple to operate, and avoids the use of actuator elements that lie externally of the cylindrical body. Thus the actuator arrangement is protected against the downhole environment. Also the exterior dimensions of the logging tool are kept as compact as possible.

Conveniently in preferred embodiments of the disclosed apparatus, the cylindrical body includes at least one reaction surface against which a bearing part of a said movable landing extension bears when in the extended position, the locations of the reaction surface and bearing part being such that engagement of the exposed landing surface with a landing surface of a further component causes pressing of the bearing surface and the reaction surface together so as to stabilise the movable landing extension in at least the first extended position.

A preferred embodiment of the present disclosure has three said movable landing extensions supported at equiangular spacings about a circumference of the cylindrical body.

The inventors have found it desirable to have three movable landing extensions but the disclosed apparatus is not limited to this number. More or fewer or arrays of movable landing extensions therefore may be employed, in regular or irregular patterns.

Further preferably the circumference is so located and the movable landing extensions are of such a length that on engagement of the one or more exposed landing surfaces with one or more landing surfaces of a further component at least part of the logging tool may extend beyond the one or more landing surfaces of the further component on the opposite side thereof to that on which the one or movable landing surfaces are located.

Preferred embodiments of the disclosed apparatus include one or more on-board memory and one or more on-board power source operatively connected to one or more transmitters and/or receivers of logging energy.

Some advantages of such self-powered logging tools are known per se. The logging tool of the present disclosure when configured as a self-powered tool for the first time permits a logging or conveyance engineer to carry out an enhanced tool drop-off method, in which the tool may be selectively caused to travel out of the drill pipe supported on wireline for logging of open hole regions of the borehole, and also, at a different time, be secured using landing components in a manner partly protruding from drill pipe. In the latter configuration the wireline is disconnected and the tool relies on its on-board power source and memory.

The subject matter of the present disclosure is considered to reside in a logging tool as defined herein when inside a hollow drillpipe that includes a landing ring defining a said landing surface of a further component.

Disclosed is a logging tool or logging tool sub (e.g., logging apparatus) for downhole use comprising an elongate cylindrical body having one or more landing surfaces that are engageable with one or more movable landing extensions attached to a further component, wherein each movable landing extension is movable between at least one extended position and a retracted position.

The subject matter of the present disclosure also resides in a method of using the logging tool as defined herein, wherein the method comprises the steps of:

a. running in drill pipe to a chosen depth in a well or borehole;
b. causing a logging tool or logging tool sub connected to wireline and according to the present disclosure to move in the drill pipe towards a downhole end;
c. causing movement of the one or more movable landing extensions to at least a first extended position;
d. causing the logging tool or logging sub to move further towards the downhole end such that the exposed landing surfaces engage one or more landing surfaces of or connected to the drillpipe thereby halting movement of the logging tool or logging sub with at least part of the logging tool or logging sub protruding externally of the drillpipe;
e. causing disconnection of the wireline from the logging tool or logging sub;
f. withdrawing the wireline from the drillpipe in an uphole direction; and
g. withdrawing the drillpipe towards an uphole direction while operating the logging tool or logging sub to log the well or borehole.

It is preferable if the method further includes the steps of:

h. before Step d., causing movement of the one or more movable landing extensions to the retracted position;
i. causing the logging tool or logging sub to move further towards the downhole end such that at least part of the logging tool or logging sub emerges from the downhole end of the drill pipe into openhole;
j. initiating logging of the well or borehole in openhole using the logging tool or logging sub operatively connected to the wireline; and
k. causing withdrawal of the wireline in an uphole direction to cause housing of the logging tool or logging sub inside the drill pipe.

Further preferably Step g. includes using the on-board memory and the on-board power source.

The drill pipe could be a conventional drill pipe or a "narrow diameter" drill pipe, the meaning of which would be known to the person of skill in the art.

When the logging tool or logging tool sub includes landing extensions that are movable to a further extended position, preferably the method includes one or more of the steps of:

l. causing movement of one or more said movable landing extensions from the first extended position to the further extended position;
m. causing movement of one or more said movable landing extensions from the further extended position to the first extended position;
n. causing movement of one or more said movable landing extensions from the further extended position to the retracted position.

The foregoing summary is not intended to summarize each potential embodiment or every aspect of the present disclosure.

BRIEF DESCRIPTION OF THE DRAWINGS

There now follows a description of preferred embodiments of the present disclosure, by way of non-limiting example, with reference being made to the accompanying drawings in which.

DETAILED DESCRIPTION

Referring to FIGS. 3, 4, 5 and 6 of the drawings there is shown a logging tool or logging tool sub (e.g., logging apparatus) 10 that as is commonly the case is an elongate, hollow metal cylinder. Parts of the logging tool intended to energise a subterranean formation or receive logging signals from underground rock are for clarity not shown in the figures. These features may take a wide range of forms that would be known to the person of skill in the art.

The cylindrical body 11 of the logging tool 10 supports in the illustrated embodiment three movable landing extensions in the form of pivotably deployable arms 12 secured on the exterior of the cylindrical body 11 in the manner described below.

Figure 3:
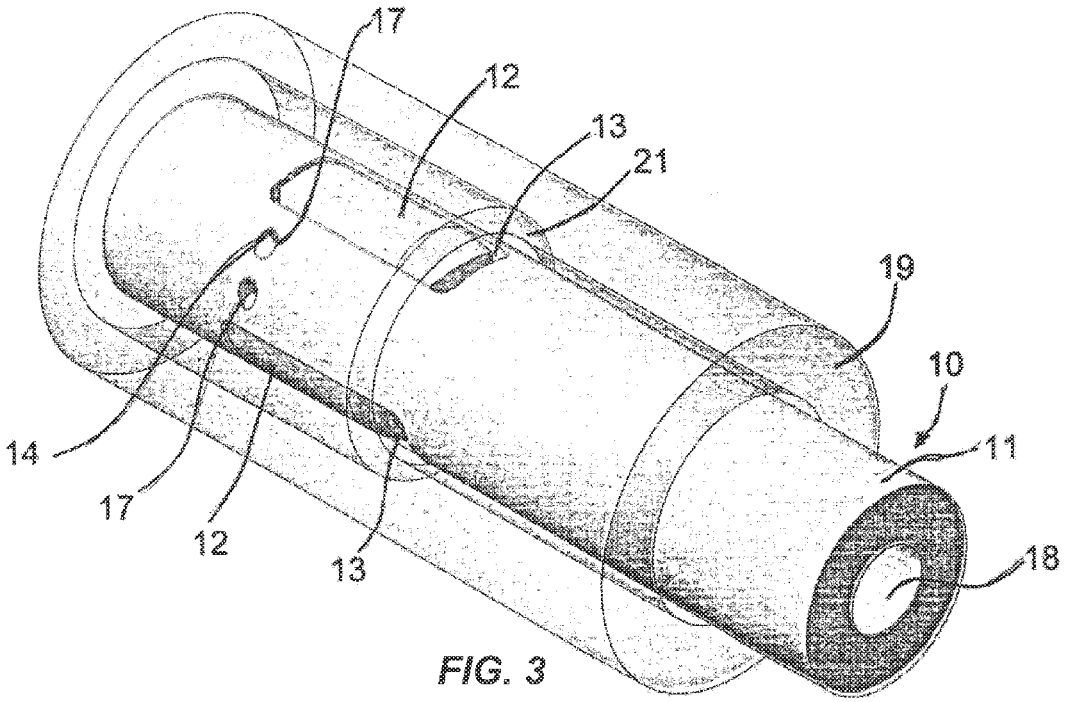
FIG. 3 is a partly transparent, three-dimensional view of a logging tool according to the present disclosure inserted into drill pipe and having movable landing extensions in a retracted configuration.
Figure 4:
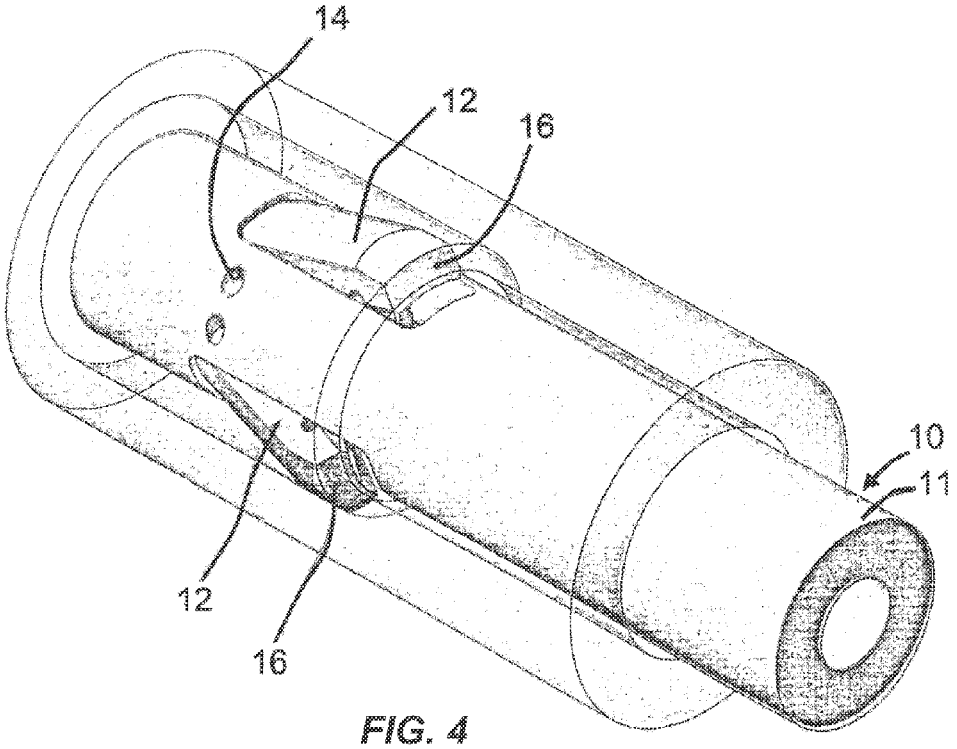
FIG. 4 shows the FIG. 3 arrangement, with the movable landing extensions deployed so as to engage a landing ring formed inside the drill pipe.

In the preferred embodiment of the present disclosure shown in FIGS. 3 and 4 three arms 12 are provided equiangularly spaced about the external circumference of the logging tool. As a result of the orientation of the logging tool in the figures only two of the arms 12 are visible.

However other numbers and patterns of the arms 12 are possible within the scope of the present disclosure. It is not essential that the arms are equiangularly spaced about a circumference of the tool 10, or indeed that they are secured at a common circumference. Indeed various irregular patterns of the arms 12 are possible but the regular arrangement shown is preferred because (a) it permits even accommodation of forces when, as described below, the arms 12 engage a drill pipe landing ring; and (b) landing of the tool may be effected reliably and repeatably.

In the preferred embodiment the arms 12 lie near to the in-use uphole end of the logging tool 10 so that a major part of the length of the tool 10 extends in a downhole direction from the circumference at which the arms 12 are secured. This feature is of benefit when deploying the tool 10 in a drop-off manner so that part of the tool protrudes beyond the open end of drill pipe in a borehole.

The arms are elongate, essentially rectangular members that extend parallel to the longitudinal axis of the logging tool. As shown in FIG. 3 the arms 12 are received within respective essentially rectangular recesses 13 that are aligned in register with the arms 12 and are dimensioned so that the arms 12 are neatly receivable in them as illustrated. The depth of each recess 13 is such that when the arms 12 are in the retracted position shown they protrude outwardly no further than the material of the cylindrical body 11, and indeed in preferred embodiments of the present disclosure lie flush with the exterior of the body 11.

At its in-use uphole end, each recess 13 includes secured therein a transversely extending pivot pin 14 that extends across the recess from one major side to the other, opposite side.

Each pivot pin 14 perforates one of the arms 12 near its uphole end and retains it pivotably captive relative to the cylindrical body 11. The dimensions of the parts are such that the arms 12 may pivot between the retracted position of FIG. 3 and an extended position as shown in FIG. 4.

In the latter configuration the uphole ends of the arms 12 retract slightly into the associated recesses as a result of pivoting about the pivot pins; and the downhole ends protrude noticeably beyond the exterior of the cylindrical body.

The in use most downhole ends of the arms 12 are formed as reaction surfaces 16 that are engageable with drill pipe landing rings of conventional designs, as further described below.

The nature of the pivoting of the arms 12 is such that in the configuration shown in FIG. 4 they have been moved "over centre" with the result that any compressive force applied to the reaction surfaces 16 tends to drive the arms further in the direction of outward pivoting. The shapes and sizes of the recesses 13 however are such that the uphole ends of the arms engage the material of the cylindrical body 11 in order to limit the extent to which the arms 12 pivot outwardly to the position shown in FIG. 4. The result is a very strong arrangement in compression.

As illustrated the pivot pins 14 are secured in chord bores 17 formed in the material of cylindrical body 11. Each pivot pin may be e.g. a press fit at either end in a pair of such chord bores, so that the pivot pin spans the recess in which it is fixed from one major side to the other. However other methods of securing the pins are possible within the scope of the present disclosure.

Figure 6:
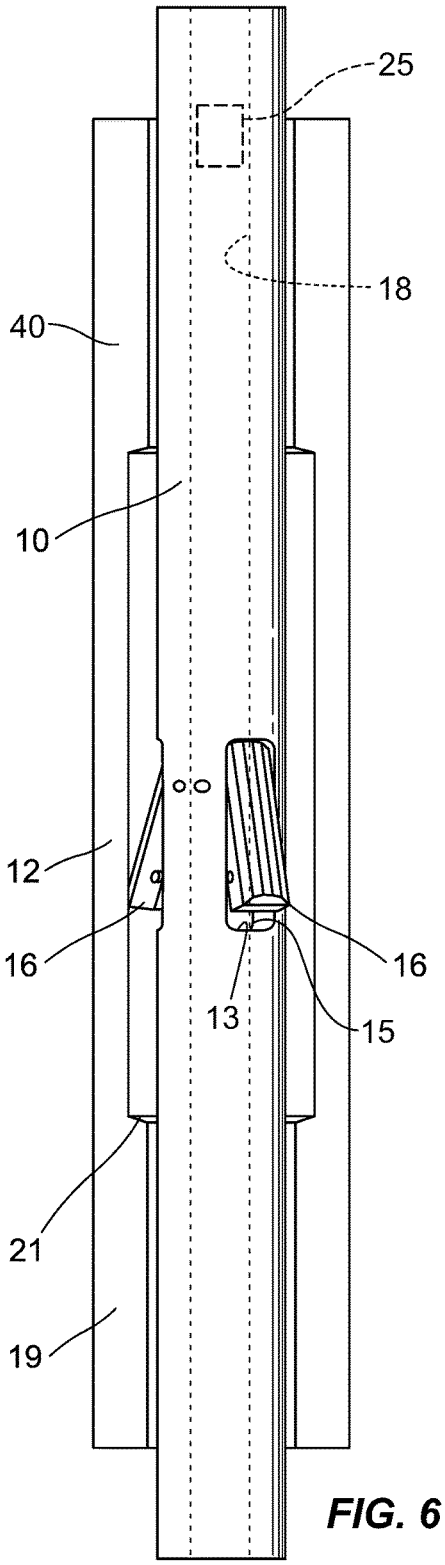
FIG. 6 shows the logging tool of FIG. 5 inside the drill pipe, with the movable landing extensions in extended positions.

As shown somewhat schematically in FIGS. 3, 4, and 4 6, the interior 18 of the logging tool or sub 10 is hollow and extends as a plain bore along the length of the tool/sub 10. At least one of the recesses 13, and in practice all of them, includes a perforation 15 (shown in FIG. 6) that provides communication between the recess 13 and the hollow interior 18. Thus, an actuator member (25 shown in FIG. 6) that is moveable inside the hollow interior (for example under the influence of a mechanical actuation drive, or pumped fluid) can move along the hollow interior 18 for the purpose of selectively engaging the arms 12 via the perforations 15.

The parts of the arms 12 adjacent the perforations 15, and/or the actuator member 25, may include one or more cam or similar actuator surfaces. As a result, movement of the actuator member 25 along interior 18 may cause engagement of the cams to make the arms 12 as desired move between the configurations shown respectively in FIGS. 3 and 4.

In particular, the arrangement could be such that driving of the actuator member 25 in a downward direction can cause movement of the arms 13 to the FIG. 4/FIG. 6 position; and driving of the actuator member 25 in an uphole direction can cause movement of the arms 12 back to the retracted configuration of FIG. 3. Various techniques for commanding movement of the actuator member 25 even when the tool/sub 10 is far downhole are known in the logging tool art.

The tool/sub 10 preferably includes an on-board power source and an on-board memory device that are operatively connected in per se known ways associated with self-powered logging tools. These features are of benefit when operating the tool/sub in accordance with a preferred method as described below.

Figure 2:
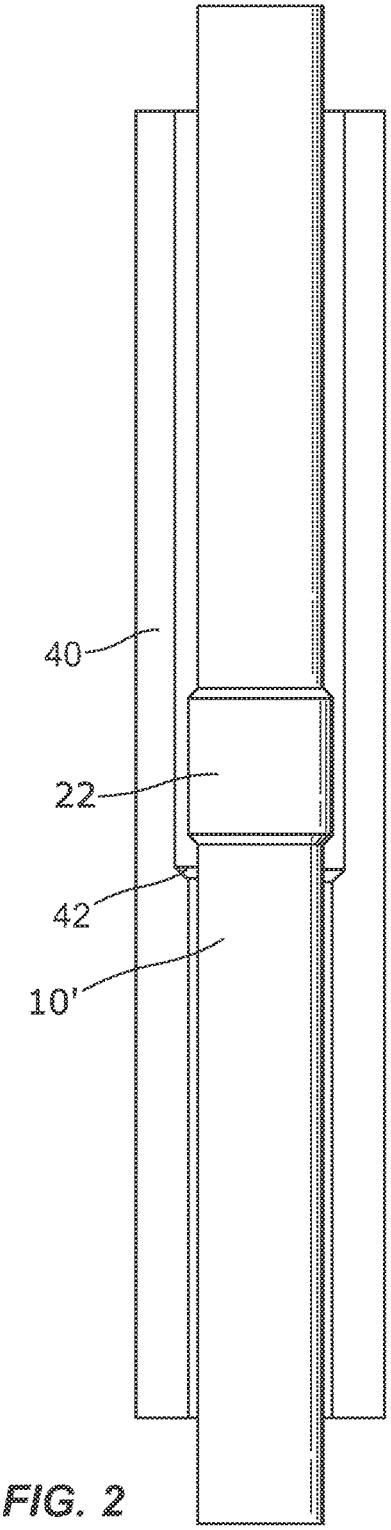
FIG. 2 (Prior Art)
FIG. 2 shows in transversely sectioned view a prior art logging tool inside a drill pipe having a conventional landing ring.
Figure 5:
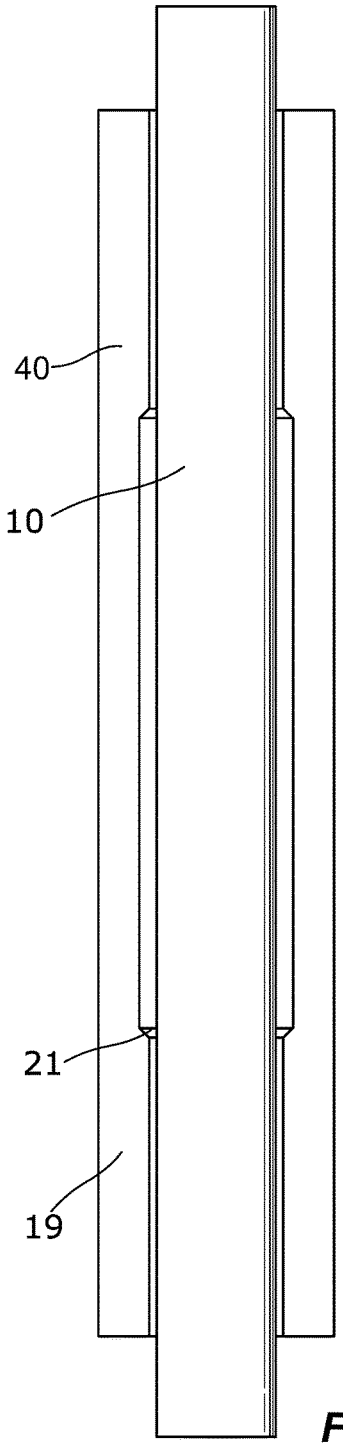
FIG. 5 shows in transversely sectioned view the logging tool of the present disclosure inside the drill pipe.

As noted FIGS. 3 and 4 show the tool/sub 10 inserted inside hollow metal drill pipe 19 having an internal landing ring 21 of a per se known design. As best illustrated by FIG. 5 the tool 10 of the present disclosure is able, when the arms 12 are retracted as illustrated in FIG. 3, to pass along the drill pipe even at locations at which the landing ring 21 narrows the internal bore of the pipe 19. This is in contrast to a conventional (prior art) logging tool 10' having a permanently protruding, external landing collar 22 as shown in FIG. 2. In this prior art arrangement movement of the tool 10' in a downhole direction is limited by engagement of the landing collar 22 with the landing ring 21. As a result the tool 10' can only be used in a conventional drop-off deployment method.

The logging tool 10 of the present disclosure, however, permits deployment in new ways that have not been available in the prior art.

Figure 1:
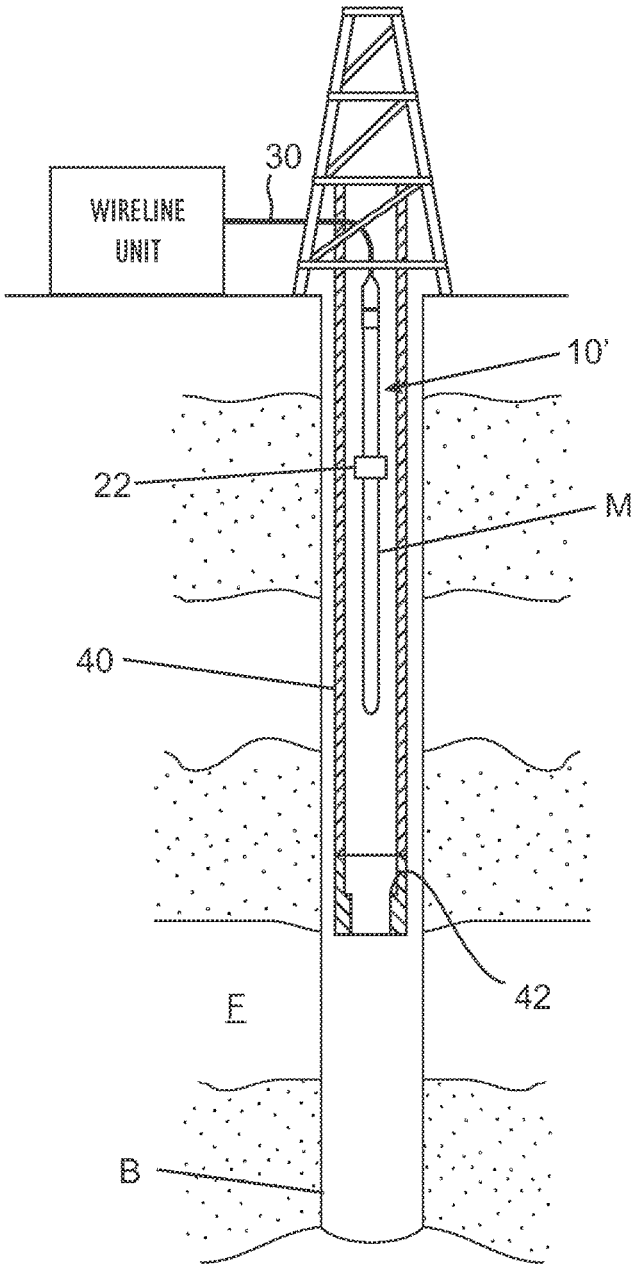
FIG. 1 (Prior Art)
FIG. 1 schematically shows a technique according to the prior art for dropping off a prior art logging tool inside a drill pipe.

Using the apparatus of the present disclosure, a much more efficient technique is possible than found in the prior art as seen in FIGS. 1-2. Aspects of the present techniques can use similar components and steps to those described above with reference to FIGS. 1-2 so that they are not repeated here. In the event of any borehole sections being un-logged in a pass of the tool 10 in an uphole direction, it is necessary only to send the wireline (30) back to the tool 10 and reattach it. The wireline (30) or other activation means then can command the actuator to cause withdrawal of the arms 12 to the retracted position of FIG. 3. At this point as illustrated by FIG. 5 the tool 10 is able to pass through the landing ring 21 of the drill pipe 40 and exit into open hole.

The tool 10 may then log the missed regions in open hole before being withdrawn on the wireline (30) partially back inside the drill pipe 40 (until the arms 12 again lie uphole of the landing ring 21). At such a time the wireline (30) may be used to telemeter the log data to a surface location where they are processed.

The wireline (30) or other activation means then may command the actuator to cause deployment of the arms 12 to the extended position of FIG. 4/FIG. 6 whereupon the reaction surfaces 16 engage the landing ring 21 with the tool "dropped off" and partially protruding from the downhole end of the drill pipe 40. The wireline (30) is then disconnected from the tool 10 and withdrawn from the drill pipe 40, whereupon conventional drop off logging may resume. At the end of this process the tool 10 is recovered from the drill pipe 40 and the logged data downloaded from the on-board memory (M) for further processing.

This method saves considerable time compared with the prior art, and renders economic the re-logging of missed parts of wells and other boreholes.

A variation on the method of the present disclosure described above involves maintaining the arms 12 in the retracted position when the tool 10 first passes along the drill pipe 40. The tool 10 as a first step therefore may be caused to exit the drill pipe 40 into openhole and carry out logging operations. The log data at this time would be transmitted to a surface location using the wireline (30), which at this point remains connected.

Following completion of such operations the tool 10 may then be pulled on the wireline (30) back inside the drill pipe 40 to its dropped off position, at which point the arms 12 may be deployed under commands transmitted by the wireline (30) or other activation means and the wireline disconnected and withdrawn after landing of the arms 12 on the landing ring 21. Thereafter drop off logging may take place.

Other activation means, as mentioned in the foregoing paragraphs, may include the use of magnets or RFID technology.

As noted the free ends of the arms 12 are shaped to facilitate engagement with the landing ring 21. Other shapes than those shown are possible within the scope of the present disclosure.

The arms 12 preferably are relatively squat in order to assist in resisting the compressive forces that they primarily have to withstand.

The listing or discussion of an apparently prior-published document in this specification should not necessarily be taken as an acknowledgement that the document is part of the state of the art or is common general knowledge.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A logging apparatus for downhole use, the apparatus comprising:

a downhole component defining an internal bore and having one or more first landing surfaces, the one or more first landing surfaces comprising a first shoulder defining a passage in the internal bore; and an elongate cylindrical body having supported thereby one or more moveable landing extensions that are moveable between:

at least a first extended position in which part of each of the one or more moveable landing extensions protrudes beyond an exterior of the cylindrical body so as to define one or more exposed second landing surfaces that are engageable with the one or more first landing surfaces; and a retracted position in which each of the one or more moveable landing extensions extends no further than the exterior of the cylindrical body, wherein the one or more exposed second landing surfaces comprise one or more second shoulders moveable between the retracted position inside the passage and the first extended position outside the passage.

2. The logging apparatus according to claim 1, wherein each of the one or more moveable landing extensions is moveable to a second extended position in which the part of each moveable landing extension protrudes further beyond the exterior of the cylindrical body than the first extended position.

3. The logging apparatus according to claim 1, wherein each of the one or more moveable landing extensions includes an elongate arm that extends from the cylindrical body, that is secured at a first location to the cylindrical body and that defines one or more of the exposed second landing surfaces at a second location that is spaced from the first location, the orientation of the one or more exposed second landing surfaces causing the arm to be subject to compression between the first and second locations on engagement of the one or more exposed second landing surfaces with the one or more first landing surfaces.

4. The logging apparatus according to claim 1, wherein each of the one or more moveable landing extensions includes an elongate arm that extends from the cylindrical body, that is secured at a first location to the cylindrical body and that defines one or more of the exposed second landing surfaces at a second location that is spaced from the first location, the orientation of the one or more exposed second landing surfaces causing the arm to be subject to compression between the first and second locations on engagement of the one or more exposed second landing surfaces with the one or more first landing surfaces; and wherein each respective moveable landing extension is pivotably secured to the cylindrical body at the first location.

5. The logging apparatus according to claim 1, wherein the cylindrical body includes a respective recess within which each of the one or more moveable landing extensions is receivable when in its retracted position.

6. The logging apparatus according to claim 5, wherein each of the one or more moveable landing extensions includes an elongate arm that extends from the cylindrical body, that is secured at a first location to the cylindrical body and that defines one or more of the exposed second landing surfaces at a second location that is spaced from the first location, the orientation of the one or more exposed second landing surfaces causing the arm to be subject to compression between the first and second locations on engagement of the one or more exposed second landing surfaces with the one or more first landing surfaces;

wherein each respective moveable landing extension is pivotably secured to the cylindrical body at the first location; and wherein the apparatus includes a pivot pin, to which each respective moveable landing extension is pivotably secured, extending inside each respective recess.

7. The logging apparatus according to claim 1, wherein the cylindrical body includes a respective recess within which each of the one or more moveable landing extensions is receivable when in its retracted position;

wherein the cylindrical body includes a hollow interior; and wherein the respective recess includes a perforation permitting communication between the hollow interior and the respective moveable landing extension.

8. The logging apparatus according to claim 1, wherein the cylindrical body includes a respective recess within which each of the one or more moveable landing extension is receivable when in its retracted position;

wherein the cylindrical body includes a hollow interior;

wherein said the respective recess includes a perforation permitting communication between the hollow interior and the respective moveable landing extension; and wherein the apparatus includes a moveable actuator member in the hollow interior of the cylindrical member, the moveable actuator member being engageable with the respective moveable landing extension via the perforation, movement of the moveable actuator member in a predetermined direction in the hollow interior when engaged with the respective moveable landing extension causing movement of the respective moveable landing extension from the retracted to at least the first extended position.

9. The logging apparatus according to claim 1, wherein each of the one or more moveable landing extensions includes an elongate arm that extends from the cylindrical body, that is secured at a first location to the cylindrical body and that defines one or more of the exposed second landing surfaces at a second location that is spaced from the first location, the orientation of the one or more exposed landing surfaces causing the arm to be subject to compression between the first and second locations on engagement of the one or more exposed second landing surfaces with the one or more first landing surfaces;

wherein each respective moveable landing extension is pivotably secured to the cylindrical body at the first location; and wherein the cylindrical body includes at least one reaction surface against which a bearing part of the respective moveable landing extensions bears when in the extended position, the locations of the reaction surface and bearing part being such that engagement of the exposed second landing surface with the first landing surface causes pressing of the bearing surface and the reaction surface together so as to stabilize the respective moveable landing extension in at least the first extended position.

10. The logging apparatus according to claim 1, including three of the one or more moveable landing extensions supported at equiangular spacings about a circumference of the cylindrical body.

11. The logging apparatus according to claim 1, including three of the one or more moveable landing extensions supported at equiangular spacings about a circumference of the cylindrical body; wherein the circumference is so located and the moveable landing extensions are of such a length that, on engagement of the one or more exposed second landing surfaces with the one or more first landing surfaces, at least part of the elongate cylindrical body may extend beyond the one or more first landing surfaces on a first side of the downhole component of the apparatus opposite to the one or more first landing surfaces on a second side of the downhole component on which the one or moveable landing extensions are located.

12. The logging apparatus according to claim 1, including an on-board memory and an on-board power source operatively connected to one or more transmitters and/or receivers of logging energy.

13. The logging apparatus according to claim 1, wherein the logging apparatus is for use inside hollow drill pipe, the drill pipe including a landing ring that defines the one or more first landing surfaces.

14. The logging apparatus of claim 1, wherein the internal bore has a first diameter, and wherein the one or more first landing surfaces comprise a counterbore defined in the internal bore, the counterbore having a second diameter greater than the first diameter.

15. The logging apparatus of claim 1, wherein the elongated cylindrical body defines an elongated length and defines an external cylindrical surface along the elongated length; and wherein the one or more moveable landing extensions in the retracted position are flush with the external cylindrical surface.

16. The logging apparatus of claim 1, wherein the downhole component defines the internal bore along an axis; and wherein the one or more first landing surfaces are disposed about a circumference of the internal bore and are angled to intersect the axis.

17. The logging apparatus of claim 1, wherein the one or more first landing surfaces comprise a corner defined about a circumference of the internal bore; and wherein each of the one or more moveable landing extensions comprises an arm having a secured end and a free end, the secured end pivotably secured to the cylindrical body, the free end having one of the second landing surfaces and being pivotable about the secured end, the arm having the free end pivoted in the at least one extended position and engaged with the corner compressively supporting a load of the cylindrical body.

18. A method of using a logging apparatus for downhole, the apparatus comprising a downhole component defining an internal bore and having one or more first landing surfaces, the one or more first landing surfaces comprising a first shoulder defining a passage in the internal bore, the apparatus further comprising an elongate cylindrical body having supported thereby one or more moveable landing extensions that are moveable between at least a first extended position in which part of each moveable landing extension protrudes beyond an exterior of the cylindrical body so as to define one or more exposed second landing surfaces that are engageable with the one or more first landing surfaces; and a retracted position in which each of the one or more moveable landing extensions extends no further than the exterior of the elongate cylindrical body, wherein the one or more exposed second landing surfaces comprise one or more second shoulders moveable between the retracted position inside the passage and the first extended position outside the passage, the method comprising the steps of:

a. running in drill pipe to a chosen depth in a well or borehole, the drill pipe having the downhole component toward a downhole end;

b. causing the elongate cylindrical body of the logging apparatus connected to wireline to move in the drill pipe towards the downhole end;

c. causing movement of the one or more moveable landing extensions to at least the first extended position;

d. causing the elongate cylindrical body of the logging apparatus to move further towards the downhole end such that the one or more exposed second landing surfaces engage the one or more first landing surfaces of the downhole component thereby halting movement of the elongate cylindrical body of the logging apparatus with at least part of the elongate cylindrical body of the logging apparatus protruding externally of the drill pipe;

e. causing disconnection of the wireline from the elongate cylindrical body of the logging apparatus;

f. withdrawing the wireline from the drill pipe in an uphole direction; and g. withdrawing the drill pipe towards an uphole direction while operating the elongate cylindrical body of the logging apparatus to log the well or borehole.

19. The method according to claim 18, including the steps of:

h. before Step d., causing movement of the one or more moveable landing extensions to the retracted position;

i. causing the elongate cylindrical body of the logging apparatus to move further towards the downhole end such that the at least part of the elongate cylindrical body of the logging apparatus emerges from the downhole end of the drill pipe into openhole;

j. initiating logging of the well or borehole in openhole using the elongate cylindrical body of the logging apparatus operatively connected to the wireline; and k. causing withdrawal of the wireline in an uphole direction to cause housing of the elongate cylindrical body of the logging apparatus inside the drill pipe.

20. The method according to claim 18, wherein the logging apparatus includes an on-board memory and an on-board power source operatively connected to one or more transmitters and/or receivers of logging energy, and wherein Step g. includes using the on-board memory and the on-board power source.

21. The method according to claim 18, wherein each of the one or more moveable landing extensions is moveable to a second extended position in which the part of each moveable landing extension protrudes further beyond the exterior of the cylindrical body than the first extended position, and wherein the method includes one or more of the steps of:

l. causing movement of one or more the moveable landing extensions from the first extended position to the second extended position;

m. causing movement of one or more the moveable landing extensions from the second extended position to the first extended position; and n. causing movement of one or more the moveable landing extensions from the second extended position to the retracted position.

* * * * *